US006078247A

United States Patent [19]

Shimomura

[11] Patent Number: 6,078,247

[45] **Date of Patent: *Jun. 20, 2000**

[54] MULTI-DIRECTION INPUT DEVICE

[75] Inventor: Hisato Shimomura, Miyagi-ken, Japan

[73] Assignee: Alps Electric Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/126,028

[22] Filed: Jul. 29, 1998

[30] Foreign Application Priority Data

Jul. 30, 1997 [JP] Japan ..... 9-204806

[51] Int. Cl.[7] ..... H01C 10/16

[52] U.S. Cl. ..... 338/131; 338/160; 338/161; 200/6 A

[58] Field of Search ..... 338/131, 132, 338/128, 108, 98, 91, 160, 161; 200/4, 18, 339, 336, 6 A

[56] References Cited

U.S. PATENT DOCUMENTS

| | | | |
|---|---|---|---|
| 3,394,611 | 7/1968 | Beurrier | 338/128 |
| 4,375,631 | 3/1983 | Goldberg . | |
| 4,559,420 | 12/1985 | Yamada | 200/6 A |
| 4,587,510 | 5/1986 | Kim | 338/128 |
| 4,620,176 | 10/1986 | Hayes | 338/128 |
| 5,229,742 | 7/1993 | Miyamoto et al. . | |
| 5,473,325 | 12/1995 | McAlindon | 200/6 A |
| 5,823,057 | 10/1998 | Hsien | 74/471 X |

FOREIGN PATENT DOCUMENTS 7-35362 8/1995 Japan .

*Primary Examiner*—Michael L. Gellner
*Assistant Examiner*—Richard K. Lee
*Attorney, Agent, or Firm*—Brinks Hofer Gilson & Lione

[57] ABSTRACT

In conventional multi-direction input devices, the operating shaft is formed as a cylinder by machining using a lathe or the like, so that the machining takes a lot of time, resulting in a rather high cost.

Disclosed is a multi-direction input device in which the operating shaft 14 is formed of a plate material by stamping using a press or the like, so that the operating shaft has a substantially rectangular cross-sectional configuration, where it is possible to produce a large number of operating shafts 14 in a short time and with high dimensional accuracy, therefore achieving a reduction is cost.

13 Claims, 4 Drawing Sheets

MULTI-DIRECTION INPUT DEVICE

BACKGROUND OF THE INVENTION

1. Field of the Invention

The present invention relates to a multi-direction input device which makes it possible to simultaneously operate a plurality of electric parts by operating an operating shaft.

2. Description of the Related Art

FIG. 6 shows a conventional multi-direction input device, in which an operating shaft 2 is arranged which is supported by a supporting point provided inside a box-shaped case 1 and which can be tilted around the supporting point.

This operating shaft 2 consists of a cylindrical bar of metal or the like formed by machining by means of a lathe or the like. For better machinability on the lathe, brass or the like is used as the material of the operating shaft 2.

In the case 1, two substantially semi-arcuate interlocking plates 3 and 4 are rotatably arranged. The two interlocking plates are perpendicular to each other and placed one upon the other.

The two interlocking plates 3 and 4 have longitudinal slits 3*a* and 4*a,* respectively. The operating shaft 2 is passed through the slit 3*a* of the upper interlocking plate 3, and rotatably supported inside the slit 4*a* of the lower interlocking plate 4. Using this rotatably supported portion as a fulcrum, the operating shaft can be tilted within the slit 4*a* of the interlocking plate 4.

Variable resistors 6 and 7 are attached to side plates 5 of the case 1. A pushbutton switch (not shown) is mounted to that side plate 5 which is opposite to the side plate to which one variable resistor 6 is attached.

The other end of the lower interlocking plate 4 protrudes outwardly beyond the side plate 5 to which the pushbutton switch is mounted. By pressing the knob portion of the pushbutton switch with this protruding portion, the pushbutton switch can be operated.

In operating the variable resistors 6 and 7, the operating shaft 2 is tilted, whereby the two interlocking plates 3 and 4 rotate. This rotation is transmitted to the rotation shafts (not shown) of the variable resistors 6 and 7 connected to one of the ends of the two interlocking plates 3 and 4 to knob the variable resistors 6 and 7.

When operating the pushbutton switch (not shown), the operating shaft 2 is pressed downwardly. Then, the lower interlocking plate 4 moves vertically using one end thereof on the variable resistor 6 side as a fulcrum, and the other end of the interlocking plate 4 protruding outwardly beyond the side plate 5 moves downwardly, whereby the knob portion of the pushbutton switch is pressed downwardly, thereby making it possible for the pushbutton switch to be operated.

In the above-described conventional multi-direction input device, the operating shaft 2 is formed as a cylinder by machining using a lathe or the like, so that the machining takes a lot of time, resulting in a rather high cost. Further, the use of a material of a satisfactory machinability, such as brass, leads to a high material cost.

SUMMARY OF THE INVENTION

As a first means for solving the above problems, the present invention provides a multi-direction input device comprising a first interlocking member which is rotatable and which has an elongated groove, a second interlocking member which is arranged beneath the first interlocking member so as to be perpendicular thereto, which is rotatable, and which has an elongated groove, a frame member the interior of which is bridged by the first and second interlocking members, an operating shaft which is passed through the elongated groove of the first interlocking member and rotatably supported so as to be swingable in the longitudinal direction of the elongated groove of the second interlocking member and which can be tilted in a number of directions around the rotatably supported portion, and a plurality of rotary type electric parts which are provided on the frame member and which are driven through the first and second interlocking members by operating the operating shaft, wherein the operating shaft is formed of a plate material so as to have a substantially rectangular sectional configuration and wherein the operating shaft is held in the elongated groove such that the longitudinal direction of the section is opposed to the longitudinal direction of the elongated groove of the second interlocking member.

As a second means for solving the above problems, the present invention provides a multi-direction input device wherein the above-mentioned operating shaft is made by stamping from a plate material.

As a third means for solving the above problems, the present invention provides a multi-direction input device wherein beveled portions or rounded portions are formed in corner sections of the operating shaft abutting the interlocking members.

As a fourth means for solving the above problems, the present invention provides a multi-direction input device wherein the above-mentioned beveled portions or rounded portions are formed by compression.

As a fifth means for solving the above problems, the present invention provides a multi-direction input device wherein the operating shaft is provided with a base portion positioned within the second interlocking member and a knob portion protruding from the frame member, a support hole being provided substantially at the center of a plate portion of the base portion, a support pin which is passed through the second interlocking member and the support hole being provided, the operating shaft being held by the second interlocking member.

As a sixth means for solving the above problems, the present invention provides a multi-direction input device wherein there are provided a substantially disc-like operating member held at the lower end of the operating shaft and a restoring member arranged on the lower side of the operating member so as to be vertically movable and biased upwardly, wherein a narrow forward end portion is formed at the lower end of the base portion, the sectional configuration of the forward end portion being substantially rectangular, and wherein a square hole into which the above-mentioned forward end portion is fitted is provided at the center of the operating member.

DESCRIPTION OF THE PREFERRED EMBODIMENT

A multi-direction input device according to an embodiment of the present invention will be described with reference to FIGS. 1 through 5.

Figure 1:
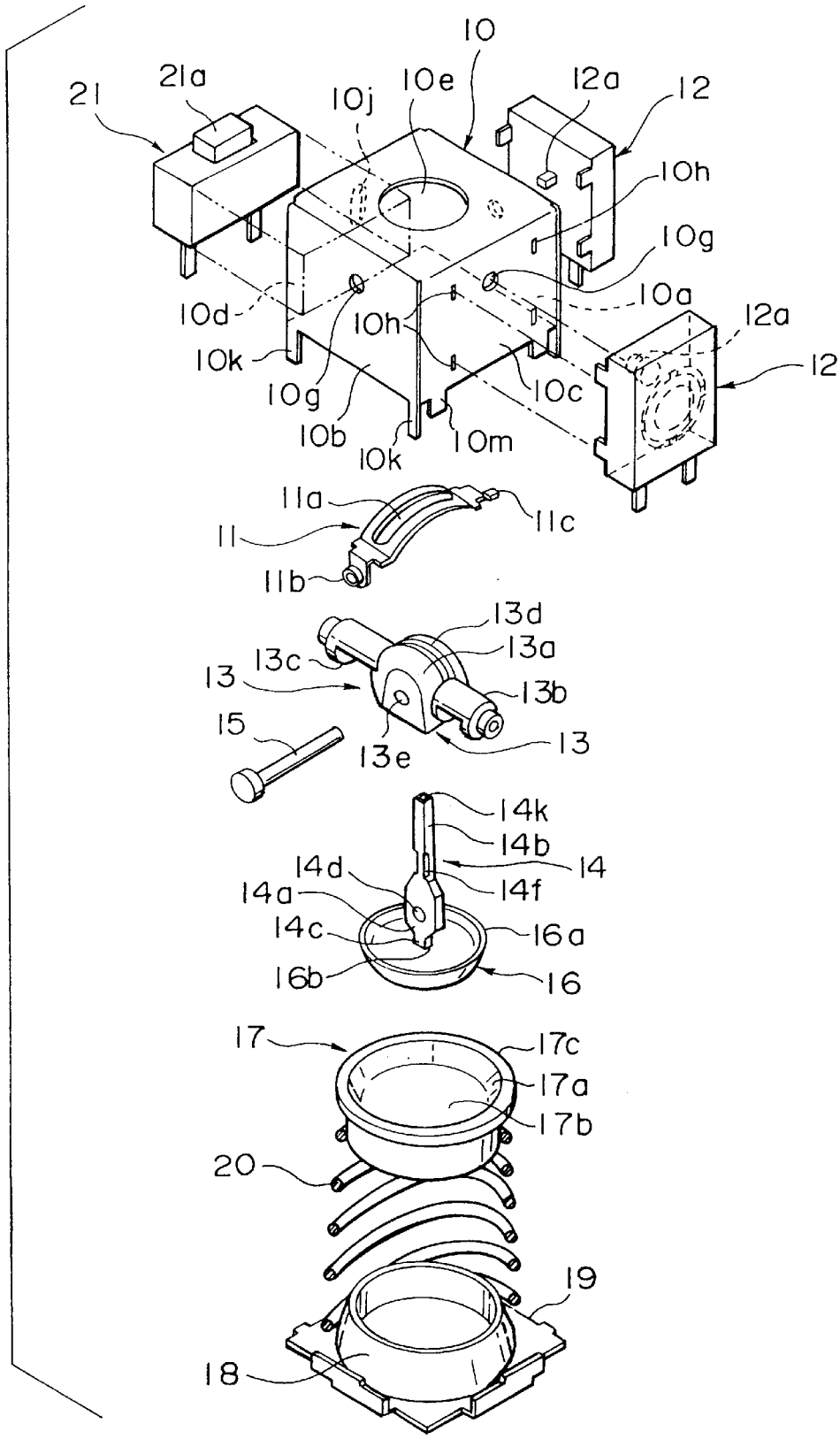
FIG. 1 is an exploded perspective view of a multi-direction input device according to the present invention.

First, as shown in FIG. 1, which is an exploded perspective view, the multi-direction input device of the present invention includes a frame member 10, which is formed of an iron plate, which is bent downwardly on four sides by a press or the like so as to substantially form a rectangular parallelepiped, which is hollow and open on the lower side.

The frame member 10 has side plates 10*a,* 10*b,* 10*c* and 10*d,* and a top plate 10*f,* which has an operating hole 10*e.*

Each of the side plates 10*a,* 10*c* and 10*d* has a round hole log and a plurality of square holes 10*h.* That side plate 10*d* which is opposed to the side plate 10*c* has a vertically elongated longitudinal hole 10*j.*

Further, the side plates 10*a* and 10*b,* which are opposed to each other, have at their lower ends mounting terminals 10*k* for mounting the multi-direction input device of the present invention to a printed circuit board or the like (not shown).

Further, the side plates 10*c* and 10*d,* which are arranged so as to be adjacent and perpendicular to the above opposed side plates 10*a* and 10*b,* have at their lower ends tongues 10*m* for mounting by caulking or the like a lower frame member 19 described below.

Inside the frame member 10, there is arranged a first interlocking member 11 formed of a phosphor bronze plate or the like. This first interlocking member 11 is curved into an arcuate configuration and has at its center a longitudinally elongated groove 11*a* formed by stamping.

One end portion 11*b* of the first interlocking member 11*b* is formed into a pipe-like configuration by drawing or the like. This end portion 11*b* is rotatably inserted into the round hole 10*g* of the side plate 10*b* of the frame member 10.

The other end portion 11*c* of the first interlocking member 11 is bent into a step-like configuration; it is rotatably inserted into the round hole 10*g* of the side plate 10*a* of the frame member 10 and protrudes outwardly from the round hole 10*g*. The first interlocking member 11 is rotatably supported by the round holes 10*g* of the side plates 10*a* and 10*b* of the frame member 10 and bridges the interior of the frame member 10.

Further, variable resistors 12 are mounted by snapping engagement or the like to the square holes 10*h* provided in the side plate 10*a* of the frame member 10 and the side plate 10*c* adjacent thereto, and rotation shafts 12*a* of the variable resistors 12 are positioned in the round holes 10*g* of the side plates 10*a* and 10*c*.

The rotation shaft 12*a* of the variable resistor 12 attached to the side plate 10*a* is engaged with the other end portion 11*c* of the first interlocking member 11 outwardly protruding from the round hole 10*g* of the side plate 10*a* of the frame member 10. When the first interlocking member 11 rotates, the rotation shaft 12*a* of the variable resistor 12 rotates to cause the resistance value of the variable resistor to vary.

Further, below the first interlocking member 11, a second interlocking member 13, which is formed of a die-cast metal material or the like or a synthetic resin material or the like, is arranged so as to be perpendicular to the first interlocking member 11.

This second interlocking member 13 has at its center a spherical portion 13*a,* from either side of which a first arm portion 13*b* and a second arm portion 13*c* extend horizontally.

The forward end portion of the first arm portion 13*b* is rotatably inserted into the round hole 10*g* of the side plate 10*c* of the frame member 10, and is engaged with the rotation shaft 12*a* of the variable resistor 12 attached to the side plate 10*c*. When the second interlocking member 13 rotates, the rotation shaft 12*a* of the variable resistor 12 also rotates.

The forward end portion of the second arm portion 13*c* protrudes outwardly from the longitudinally elongated hole 10*j* of the side plate 10*d* of the side plate 10, the second interlocking member 13 bridging the interior of the frame member 10 such that the second interlocking member 13 is rotatable and vertically swingable using the round hole 10*g* of the side plate 10*c* as a fulcrum.

Further, a thin and narrow elongated groove 13*d,* which is vertically through, is formed in the spherical portion 13*a* so as to extend in a direction perpendicular to the first interlocking member 11.

Further, a support through-hole 13*e* is formed in the spherical portion 13*a* so as to extend in a direction perpendicular to the above-mentioned elongated groove 13*d*.

There is arranged an operating shaft 14, which is passed through the elongated groove 11*a* of the first interlocking member 11 and is rotatably supported by the second interlocking member 13 such that it can be tilted in the longitudinal direction of the above-mentioned elongated groove 13*d* using the rotatably supported portion as a fulcrum. The operating shaft 14 is formed by stamping a metal plate, such as an iron plate, by means of a press or the like.

This operating shaft 14 includes a relatively wide base portion 14*a* which is situated on the lower side of the central portion as seen in the drawing. On the upper side of the central portion, there is formed a bar-like knob portion 14*b* which extends from the base portion 14*a* and has an end portion 14*k*.

At the lower end of the operating shaft, on the other side of the base portion 14*a,* a forward end portion 14*c* having a substantially rectangular outer configuration protrudes from the base portion 14*a*. Further, a support hole 14*d* is formed by stamping or the like in that part of the base portion 14*a* which is nearer to the forward end portion 14*c*.

Further, on the side surfaces of the operating shaft 14 after the stamping, there are formed a rupture surface (not shown) and a shear surface (not shown), and a drawing burr (not shown) is generated in a corner section on the rupture surface side.

Figure 2:
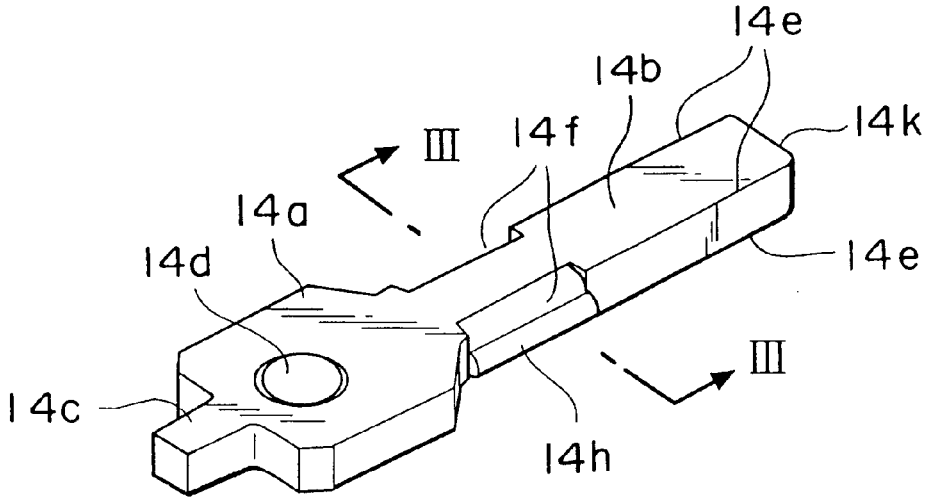
FIG. 2 is a perspective view of an operating shaft of the multi-direction input device of the present invention.

Further, as shown in FIG. 2, beveled portions 14*f* are formed in those sections of the corner portions 14*e* of the knob portion 14*b* of the operating shaft 14 which are nearer to the base portion 14*a,* and curved surface portions 14*h* are formed below them.

When this section where the beveled portions 14*f* and the curved surface portions 14*h* are formed is inserted into the elongated groove 11*a* of the first interlocking member 11, the section where the beveled portions 14*f* and the curved surface portions 14*h* are formed abuts the first interlocking member 11, which means no abutment occurs between edges, so that the operating shaft 14 can smoothly move within the elongated groove 11*a* of the first interlocking member 11, whereby the operating shaft 14 can be smoothly tilted.

Figure 3A:
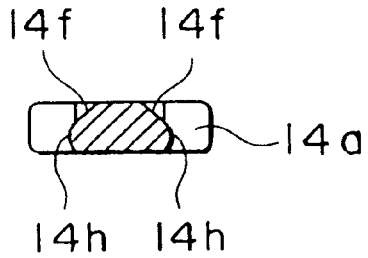
FIGS. 3A and 3B are sectional views taken along the line A—A of the multi-direction input device of the present invention.
Figure 3B:
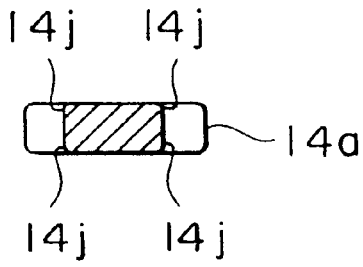

Further, the corner sections of the knob portion 14*b* abutting the first interlocking member 11 are not restricted to the beveled portions 14*f* and the curved surface portions 14*h* as shown in FIG. 3A. It is also possible to adopt a configuration as shown in FIG. 3B, in which rounded portions 14*j* are formed.

When forming the beveled portions 14*f*, the curved surface portions 14*h* or the rounded portions 14*j* by machining, the corner sections 14*e* where drawing burr is formed by the above-mentioned rupture surface are compressed by a press or the like to crush the corner sections 14*e*.

The beveled portions 14*f* and the curved surface portions 14*h* of the knob portion 14*b* of the operating shaft 14 are inserted so as to be capable of tilting in the longitudinal direction of the elongated groove 13*d* of the first interlocking member 11, and the end portion 14*k* of the knob portion 14*b* protrudes upwardly from the operating hole 10*e* of the frame member 10.

Further, the support hole 13*e* of the second interlocking member 13 is mated with the support hole 14*d* of the operating shaft 14, and a round pin 15 is inserted into the support holes 13*e* and 14*d*, one end of the round pin 15 being caulked so that the operating shaft 14 is rotatably supported such that it can be tilted in the longitudinal direction of the elongated groove 13*d* of the second interlocking member 13.

Further, attached to the substantially rectangular forward end portion 14*c* of the operating shaft 14 is an operating member 16 having a flange portion 16*a* having an arcuate portion whose radius of curvature gradually increases toward the outside.

The operating member 16 is formed of a resin material or the like, and has a dish-like outer configuration due to the flange portion 14*a*. It has at the center of its bottom a square through-hole 16*b*, into which the forward end portion 14*c* of the operating shaft 14 is fitted, whereby the operating member 16 is attached to the operating shaft 14.

Further, arranged below the operating member 16 is a dish-like restoring member 17 which is somewhat larger than the operating member 16. The restoring member 17 is formed of a resin material, and has a side wall 17*a* around it, the operating member 16 being swingably accommodated in the inner recess 17*b* thereof. Further, a flange portion 17*c* is formed at the upper end of the side wall 17*a*.

Further, there is arranged a lower frame member 19 which is formed of a die-cast metal material or the like and which has a cylindrical holding wall 18 for holding the restoring member 17 so as to be vertically movable.

Between the flange portion 17*c* of the restoring member 17 and the lower frame member 19, a restoring spring 20 is arranged in a compressed state to upwardly bias the restoring member 17.

The restoring member 17 is mounted to the lower frame member 19 such that it is prevented from being detached from the holding wall 18 by a retaining member (not shown).

Further, a pushbutton switch 21 having a knob 21*a* is attached to the side plate 10*d* of the frame member 10. Above the knob 21*a* of the pushbutton switch 21, there is positioned, with some gap therebetween, an end portion of the arm portion 13*c* of the second interlocking member 13. When the operating arm 14 is depressed downwardly, the second interlocking member 13 is swung downwardly, and the end portion of the arm portion 13*c* depresses the knob 21*a*, whereby the pushbutton switch 21 is turned on.

Figure 4:
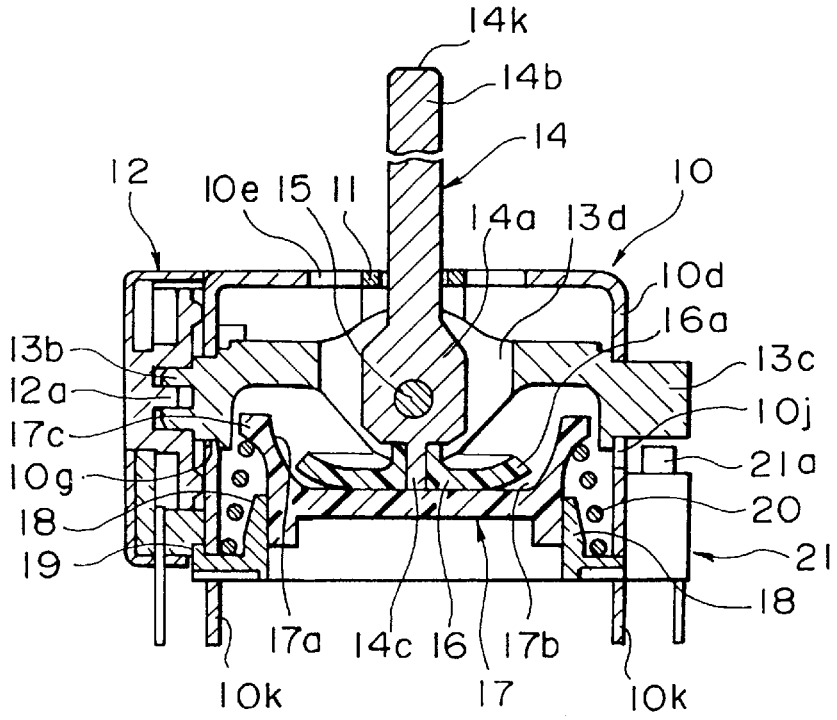
FIG. 4 is an essential-part sectional view illustrating the operation of the multi-direction input device of the present invention.

Next, the operation of the multi-direction input device of the present invention will be described. First, as shown in FIG. 4, the bottom surface of the operating member 16 mounted to the forward end portion 14*c* of the operating shaft 14 within the frame member 10 is held in elastic contact with the inner bottom surface 17*b* of the restoring member 17 by the restoring spring 20 and held in a horizontal position, the operating shaft 14 being in a vertical, neutral state.

Figure 5:
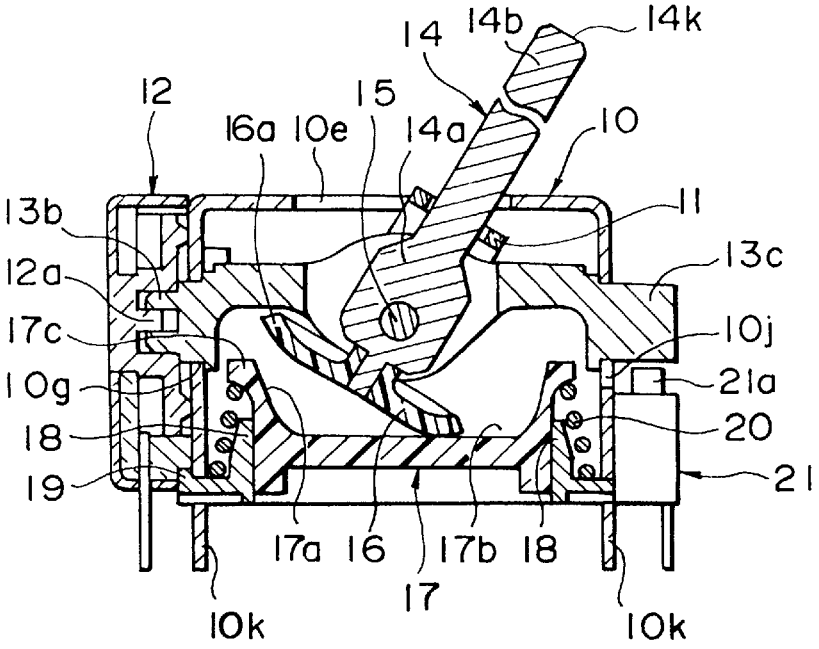
FIG. 5 is another essential-part sectional view illustrating the operation of the multi-direction input device of the present invention.
Figure 6:
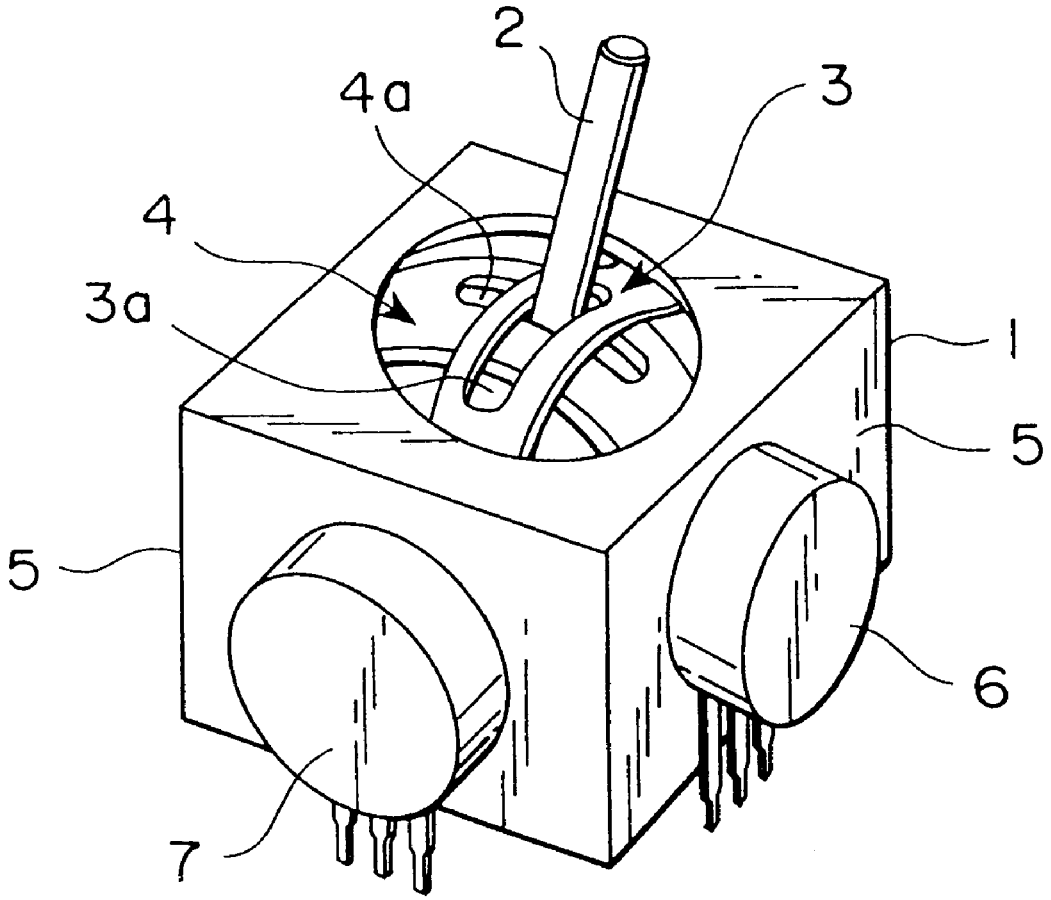
FIG. 6 PRIOR ART
FIG. 6 is a perspective view of a conventional multi-direction input device.

When an operating force is applied to the knob portion 14*b* of the operating shaft 14 in the neutral state to tilt the operating shaft 14 in an arbitrary direction as shown in FIG. 5, the operating shaft 14 is tilted using the round pin 15 as a fulcrum. As a result of this tilting of the operating shaft 14, the first interlocking member 11 and the second interlocking member 13 are rotated. With this rotation, the rotation shafts 12*a* of the above-mentioned variable resistors 12 are rotated to thereby vary the resistance value.

Further, as a result of the tilting movement of the operating shaft 14, the operating member 16, into which the forward end portion 14*c* of the operating shaft 14 is fitted, is tilted, and the outer peripheral surface of the arcuate flange portion 16*a* of the operating member pressurizes the inner bottom portion of the restoring member 17. Then, the restoring member 17 moves downwards along the support wall 18 of the lower frame member 19 against the resilient force of the restoring spring 20.

When, in this condition, the operating force that has been applied to the operating shaft 14 is cancelled, the bottom surface of the operating member 16 is brought to a horizontal state due to the resilient force of the restoring spring 20, and the operating shaft 14 is restored to the neutral state.

Next, when operating the pushbutton switch 21, the knob portion 14*b* of the operating shaft 14, which is in the neutral state as shown in FIG. 4, is pressed downwards. Then, using the forward end portion of the first arm portion 13*b* of the second interlocking member 13, which is inserted into the round hole 10*g* of the side plate 10*c* of the frame member 10, as a swinging fulcrum, the second arm portion 13*c* of the second interlocking member 13 swings downwards. Then, the forward end portion of the second arm portion 13*c*, which protrudes outwardly from the longitudinally elongated hole 10*j* of the side plate 10*d* of the frame member 10, depresses the knob 21*a* of the pushbutton switch 21, thereby making it possible to operate the pushbutton switch 21.

Thus, the multi-direction input switch of the present invention comprises a first interlocking member 11 which is rotatable and which has an elongated groove 11*a*, a second interlocking member which is arranged in a direction perpendicular to the first interlocking member 11, which is rotatable and swingable and which has an elongated groove 13*d*, a frame member 10 whose interior is bridged by the first and second interlocking members 11 and 13, an operating shaft 14 which is passed through the elongated groove 11*a* of the first interlocking member 11, which is rotatably supported by the elongated groove 13*d* of the second interlocking member 13 and which can be tilted using the rotatably supported portion as a fulcrum, and a plurality of electric parts 12 and 21 which are driven through the first and second interlocking members 11 and 13 by operating the operating shaft 14, wherein the operating shaft 14 is formed of a plate material and has a substantially rectangular cross-sectional configuration.

In the multi-direction input switch of the present invention, the operating shaft is formed of a plate material and has a substantially rectangular cross-sectional configuration, so that the operating shaft can be formed by stamping using a press or the like, whereby a large number of operating shafts can be produced in a short time. Thus, it is possible to provide a low-cost multi-direction input device.

Further, beveled portions or rounded portions are formed in corner sections of the operating shaft, and since the beveled portions or the rounded portions are formed by compression, it is possible to form the beveled portions or the rounded portions by a single stamping, so that can be formed by machining using a die for stamping the operating shaft, whereby it is possible to provide a multi-direction input device which entails no increase in cost if additional beveled portions are formed.

Further, the operating shaft is provided with a base portion positioned in the second interlocking member and a knob portion protruding from the frame member, and a support hole is provided substantially at the center of the plate surface of the base portion to hold the operating shaft, so that a series of stamping procedures enable the operating shaft to be formed, thereby achieving a reduction in cost.

Further, the forward end portion of the operating shaft has a substantially rectangular configuration, and the forward end portion is fitted into a substantially disc-like operating member held at the lower end of the operating shaft, so that it is possible for the operating member, which is mounted to the forward end portion by the fitting, to be firmly and reliably mounted. Thus, the operating member does not rotate even if the operating shaft is repeatedly tilted, thereby preventing the loosening thereof. At the same time, since the forward end portion can be formed by a series of stamping processes, it is possible to provide a multi-direction input device which is of higher performance and which is less expensive.

What is claimed is:

1. A multi-direction input device comprising a first interlocking member which is rotatable around a first axis and which has a strip elongated slot, a second interlocking member which is arranged beneath the first interlocking member so as to be perpendicular thereto, which is rotatable around a second axis, and which has a block portion at the center thereof having an elongated groove extending perpendicular to the elongated slot of the first interlocking member, a frame member, the interior of which is bridged by the first and second interlocking members, an operating shaft, a columnar knob of which is passed through the elongated slot of the first interlocking member movably supported in a longitudinal direction of the elongated slot of the first interlocking member, and a flat base portion thereof connected with the knob portion is passed through the elongated groove of the second interlocking member so as to be rotatable supported in the longitudinal direction of the elongated groove of the second interlocking member by a support hole formed in the block of the second interlocking member and a support pin passed through a support hole formed in the base portion and which can be tilted in a number of directions around a rotatably supported portion, and a plurality of rotary type electric parts which are provided on the frame member and which have rotors rotationally driven by engaging with end portions of the first and second interlocking members, wherein the operating shaft is formed from sheet metal, wherein when the knob portion of the operating shaft moves within the elongated slot of the first interlocking member in the direction of the elongated slot, the flat base portion allows the second interlocking member to be rotated around the first axis thereof while pressing the block portion of the second interlocking member in accordance with the movement of the knob portion, and when the flat base portion of the operating shaft moves within the elongated groove of the second interlocking member in the direction of the elongated groove, the knob portion allows the first interlocking member to be rotated around the second axis thereof while pressing the portion of the first interlocking member around the elongated slot of the first interlocking member in accordance with the movement of the base portion, whereby the operating shaft is tilted.

2. A multi-direction input device according to claim 1, wherein the operating shaft is made by stamping sheet metal.

3. A multi-direction input device according to claim 1, wherein beveled portions are formed in corner sections of the knob portion of the operating shaft abutting a formation section of the elongated slot of the first interlocking member.

4. A multi-direction input device according to claim 1, wherein there are provided a disc-like operating member held at the lower end of the operating shaft and a restoring member arranged on the lower side of the operating member so as to be vertically moveable and spring-biased upwardly, wherein a columnar forward end portion which is formed from sheet metal is formed at the lower end of the operating shaft, and wherein a square hole into which said forward end portion is fitted is provided at the center of the operating member, and the forward end portion of the operating shaft is fitted into said square hold so as to hold the operating member.

5. A multi-direction input device according to claim 1, wherein rounded portions are formed in corner sections of the knob portion of the operating shaft abutting a formation section of the elongated slot of the first interlocking member.

6. A multi-direction input device according to claim 3, wherein said beveled portions are formed by compression.

7. A multi-direction input device according to claim 3, wherein said rounded portions are formed by compression.

8. A multi-direction input device comprising;

a first interlocking member which is rotatable and which has a strip elongated slot;

a second interlocking member which is arranged beneath the first interlocking member so as to be perpendicular thereto, which is rotatable, and which has an elongated groove extending in a direction perpendicular to the elongated slot of the first interlocking member;

a frame member, an interior of which is bridged by the first and second interlocking members;

an operating shaft which is passed through the elongated slot of the first interlocking member and rotatably supported by the second interlocking member so as to be rotatable in a longitudinal direction of the elongated groove of the second interlocking member and which can be tilted in a number of directions around a rotatably supported portion; and a plurality of rotary type electric parts which are provided on the frame member and which have rotors rotationally driven by engaging with end portions of the first and second interlocking members, wherein the operating shaft is formed of a plate material so as to have a rectangular sectional configuration such that a longitudinal size is longer than a lateral size, wherein a first pair of parallel sidewalls of the operating shaft, which extend in a longitudinal direction of the rectangular section, are fed to and movably travel along the elongated groove of the second interlocking member and a second pair of parallel sidewalls of the operating shaft, which extend in a lateral direction of the rectangular section, abut against side faces constituting the elongated slot of the first interlocking member to allow the interlocking member to be rotated around the axis thereof in accordance therewith, and the second pair of parallel sidewalls of the operating shaft are fed to and slidably travel along the elongated slot of the first interlocking member and the first pair of parallel sidewalls of the operating shaft press side faces constituting the elongated groove of the second interlocking member to be rotated the axis thereof in accordance therewith, wherein the operating shaft has a support hole passing through the first pair of parallel sidewalls, and wherein the second interlocking member has a support through hole, and is provided with a support pin passing through the support hole of the operating shaft and the support through hole of the second interlocking member so as to rotatably support the operating shaft on the second interlocking member using the support pin as a swing fulcrum.

9. A multi-direction input device according to claim 8, wherein the operating shaft is made by stamping sheet metal.

10. A multi-direction input device according to claim 8, wherein beveled portions are formed in corner sections of the knob portion of the operating shaft abutting a formation section of the elongated slot of the first interlocking member.

11. A multi-direction input device comprising;

a first interlocking member which is rotatable and which has a strip elongated slot;

a second interlocking member which is arranged beneath the first interlocking member so as to be perpendicular thereto, which is rotatable, and which has an elongated groove extending in a direction perpendicular to the elongated slot of the first interlocking member and having a width narrower than a width of the first interlocking member;

a frame member, an interior of which is bridged by the first and second interlocking members;

an operating shaft which is passed through the elongated slot of the first interlocking member and rotatably supported by the second interlocking member so as to be swingable in a longitudinal direction of the elongated groove of the second interlocking member and which can be tilted in a number of directions around a rotatably supported portion; and a plurality of rotary type electric parts which are provided on the frame member and which have rotors rotationally driven by engaging with end portions of the first and second interlocking members, wherein the operating shaft is formed from sheet metal so as to have a rectangular sectional configuration such that a longitudinal size is longer than a lateral size, wherein a first pair of parallel sidewalls of the operating shaft, which extend in a longitudinal direction of the rectangular section, are fed to and slidably travel along the elongated groove of the second interlocking member and a second pair of parallel sidewalls of the operating shaft, which extend in a lateral direction of the rectangular section, abut against side faces constituting the elongated slot of the first interlocking member to allow the interlocking member to be rotated around the axis thereof in accordance therewith, and the second pair of parallel sidewalls of the operating shaft are fed to and slidably travel along the elongated slot of the first interlocking member and the first pair of parallel sidewalls of the operating shaft abut against side faces constituting the elongated groove of the second interlocking member to allow the second interlocking member to be rotated the axis thereof in accordance therewith, wherein the operating shaft has a support hole passing through the first pair of parallel sidewalls, and wherein the second interlocking member has a support through hole, and is provided with a support pin passing through the support hole of the operating shaft and the support through hole of the second interlocking member so as to rotatably support the operating shaft on the second interlocking member using the support pin as a swing fulcrum.

12. A multi-direction input device according to claim 11, wherein the operating shaft is made by stamping sheet metal.

13. A multi-direction input device according to claim 11, wherein beveled portions are formed in corner sections of the knob portion of the operating shaft abutting a formation section of the elongated slot of the first interlocking member.

* * * * *